US006131420A

United States Patent [19]

Zorini

[11] Patent Number: 6,131,420

[45] Date of Patent: Oct. 17, 2000

[54] PROCESS FOR MANUFACTURING IN CROCHET GALLOON MACHINES RIBBONS FOR TEAR TYPE QUICK-CLOSING DEVICES, AND A CROCHET GALLOON MACHINE FOR MANUFACTURING SAID RIBBONS

[76] Inventor: Luigi Omodeo Zorini, Via dei Mille, 71 - 27024, Cilavegna (PV), Italy

[21] Appl. No.: 09/455,074

[22] Filed: Dec. 6, 1999

[30] Foreign Application Priority Data

Dec. 23, 1998 [EP] European Pat. Off. ..... 98830781

[51] Int. Cl.[7] ..... D04B 23/16

[52] U.S. Cl. ..... 66/203; 66/85 R

[58] Field of Search ..... 66/82 R, 84 R, 66/85 R, 203, 1 R, 147, 192, 193, 195

[56] References Cited

U.S. PATENT DOCUMENTS

| | | | |
|---|---|---|---|
| 3,685,474 | 8/1972 | Frohlich et al. | 66/203 |
| 4,551,995 | 11/1985 | Louison | 66/203 |
| 4,845,962 | 7/1989 | Zorini | 66/203 |
| 5,642,631 | 7/1997 | Zorini | 66/203 |

*Primary Examiner*—Danny Worrell

*Attorney, Agent, or Firm*—Robert F.I. Conte Lee, Mann, Smith, McWilliams, Sweeney and Ohlson

[57] ABSTRACT

It is described a process for manufacturing in crochet galloon machines, ribbons of synthetic fabric provided with flexible hooks for quick-closing devices of the tear type, which process comprises a previous step of knitting a ribbon in which successive sequences of loops are formed. The ribbon is then submitted to a heat treatment adapted to substantially stiffen said loops previously shaped in an angle-bent conformation. Then a cutting operation is carried out on the stiffened loops so as to obtain one hook from each of them.

A crochet galloon machine is also provided for forming said ribbons of synthetic fabric, said machine comprising a plurality of shaping elements adapted to form successive sequences of loops with the weft threads, a heat-treatment unit for setting the geometric shape of the loops, and a cutting device intended for cutting off the stiffened loops so as to obtain one hook from each of them.

10 Claims, 4 Drawing Sheets

PROCESS FOR MANUFACTURING IN CROCHET GALLOON MACHINES RIBBONS FOR TEAR TYPE QUICK-CLOSING DEVICES, AND A CROCHET GALLOON MACHINE FOR MANUFACTURING SAID RIBBONS

FIELD AND BACKGROUND OF THE INVENTION

The present invention relates to a process for manufacturing in crochet galloon machines, ribbons of synthetic fabric provided with flexible hooks to be employed in making quick-closing devices of the so-called "tear" type, the process comprising a previous step of knitting a ribbon consisting of a plurality of parallel chains interlaced with weft threads so as to form, with said weft threads, successive sequences of loops substantially transverse to the extension direction of the chains and emerging from the ribbon surface.

The invention also relates to a crochet galloon machine for manufacturing said ribbons.

DESCRIPTION OF PRIOR ART

It is known that there are quick-closing devices of the so-called "tear" type for garments, bags, linings and other articles, consisting of two ribbons or strips of synthetic fabric, one provided with many tiny flexible hooks projecting from the fabric surface, the other having a great number of curls or closely entangled loops which project from the fabric surface as well. When the two ribbons are joined by pressure, at least part of the hooks gets caught by the loops and a fast connection between the ribbons takes place, which connection can be released by gradually moving the two ribbons away from each other with force.

The known art for manufacturing the above mentioned closing devices is generally based on use of at least two needle looms suitably modified so as to make hooks in one ribbon and curls in the other, respectively. Normally cutting of the thicker thread intended for forming the hooks of one of the two ribbons is not carried out directly on the loom, but separately thereof.

While the above-mentioned machines enable closing devices of good quality to be obtained, however they give rise to rather complicated manufacturing processes bringing about very high production costs.

Also known are crochet galloon machines enabling a ribbon provided with curls to be made at more reduced costs. These machines, like in traditional crochet galloon machines, comprise a needle bar having guide grooves for the needles disposed in side by side relationship, a plurality of eye-pointed needles arranged to engage warp threads with which chains disposed longitudinally in side by side relationship are formed, and a plurality of threading tubes each adapted to carry a corresponding weft thread.

In working, the weft threads form successive sequences of loops or curls substantially transverse to the extension direction of the chains, on a plurality of shaping elements in the form of a rod along which said loops gradually go down.

However, in the known art, manufacture of the other ribbon having flexible hooks goes on being based on the use of needle loom machines. Therefore, for manufacturing this part of the closing device of the tear type, the same limits as above mentioned are encountered.

SUMMARY OF THE INVENTION

Under this situation the technical task underlying the present invention is to provide a process and a crochet galloon machine enabling ribbons of synthetic fabric provided with flexible hooks to be made directly on one and the same crochet machine, thereby reducing the production costs.

The technical task mentioned is substantially achieved by a process for manufacturing ribbons of synthetic fabric provided with flexible hooks for quick-closing devices of the tear type in crochet galloon machines and by a crochet galloon machine for formation of same, wherein they comprise one or more of the technical solutions claimed in the following.

Description of a preferred non-exclusive embodiment of a crochet galloon machine in accordance with the invention is now given hereinafter, by way of non-limiting example, with reference to the accompanying drawings.

DESCRIPTION OF THE PREFERRED EMBODIMENTS

Figure 1:
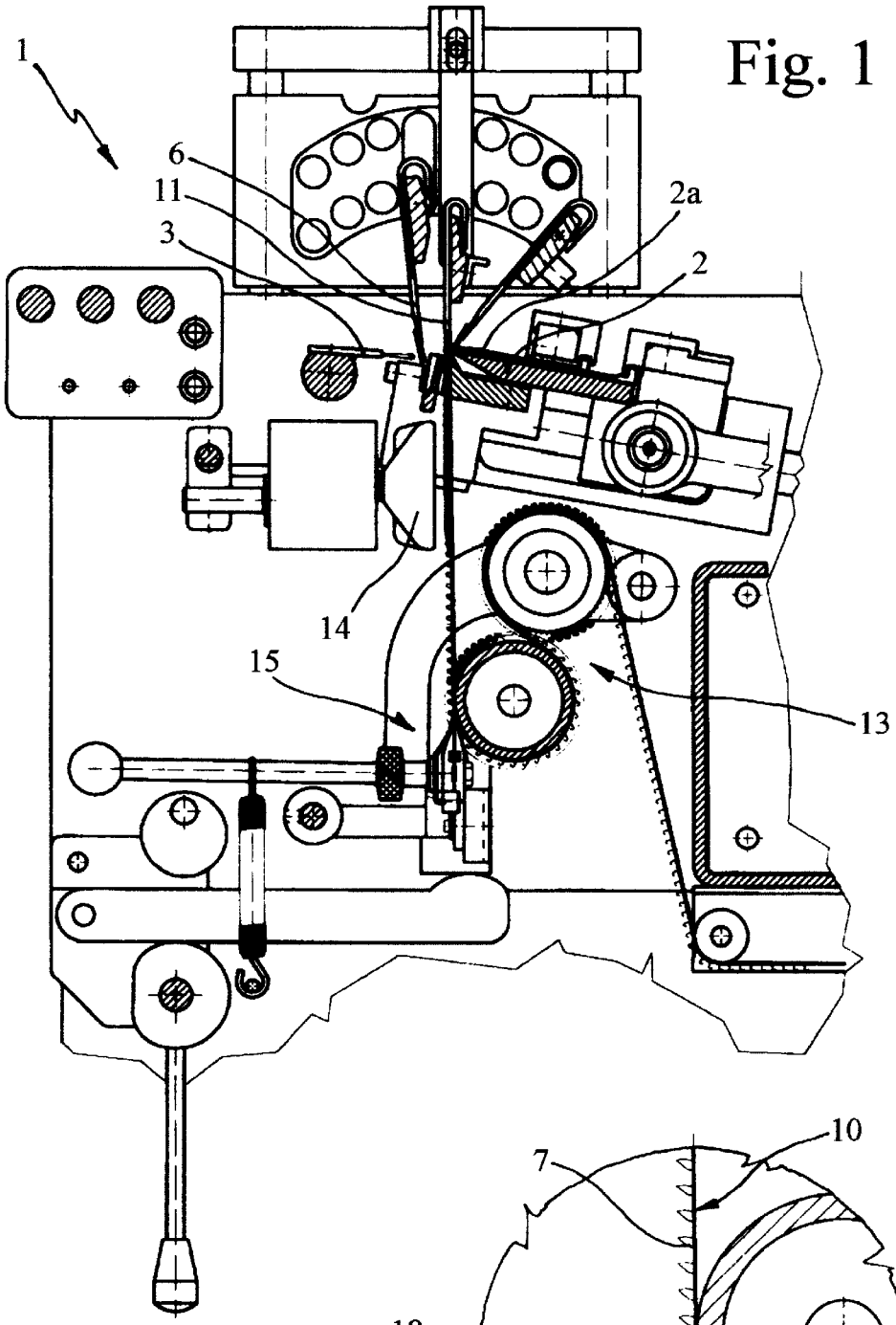
FIG. 1 is an elevation side view in section of the machine of the invention.
Figure 2:
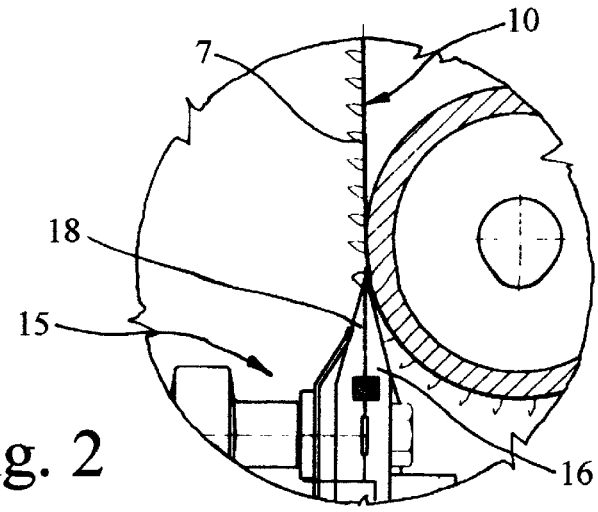
FIG. 2 shows the cutting unit of the machine to an enlarged scale with respect to FIG. 1.
Figure 4:
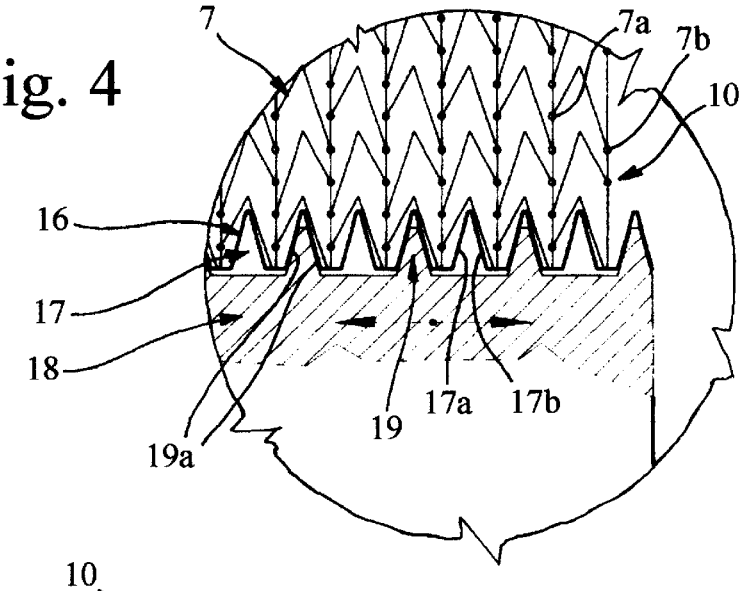
FIG. 4 is an enlarged front view of the cutting unit showing the fixed blade and the movable blade of said unit and a diagrammatic view of the ribbon before the cutting operation carried out on its loops.
Figure 3:
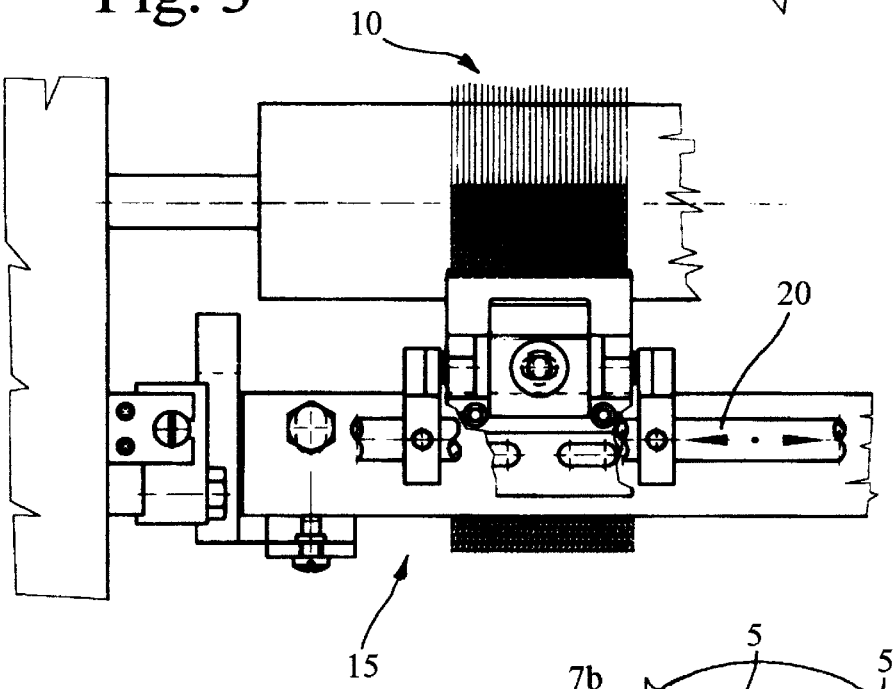
FIG. 3 is a front view of the cutting unit of the machine shown in FIG. 1.

With reference to the drawings, the crochet galloon machine in accordance with the invention has been generally identified by reference numeral 1.

In a manner known per se it comprises a needle bar 2 having guide grooves for the needles 2*a* disposed in side by side relationship, a plurality of eye-pointed needles 3, through which respective warp threads 4 pass which are intended for forming chains 5, and a plurality of threading tubes 6 each adapted to carry a respective weft thread.

In particular, weft threads of two different diameters are utilized, i.e. first weft threads of thick diameter intended for forming loops 7 each of which is disposed astride two chains disposed side by side, to be used for making flexible hooks 8, and at least one second weft thread of reduced diameter 9 to form a ribbon 10 together with the warp threads 4.

Loops 7 are formed on respective shaping elements 11 substantially defined by vertically-oriented fixed rods, each of them being disposed between two contiguous chains 5 and having an appropriate conformation in cross-section provided for example with a sharp edge so that each loop 7 is shaped into a bent conformation having an angularity 12. Practically, at each work cycle of the machine, in addition to a series of chain stitches 5*a*, as a result of the cooperation between the eye-pointed needles 3 and needles 2*a*, a sequence of loops 7 aligned transversely of the extension of chains 5 is formed. As the ribbon 10 is manufactured and dragged along by a collecting unit 13, loops 7 which are substantially transverse to the extension direction of chains 5 and emerge from the surface of ribbon 10 being worked, slide downwardly along the shaping elements 11.

In an original manner the machine 1 comprises a heat-treatment unit 14, of the type involving hot air for example, disposed below the eye-pointed needles 3 at the shaping elements 11, which is adapted to substantially stiffen the synthetic yarns forming loops 7 by heating, so as to set their geometric shape imposed to them by the shaping elements themselves. Below the heat-treatment unit 14 and upstream of the collecting unit 13 there is a cutting device 15 adapted to cut the stiffened loops 7 in order to obtain a length of hook-shaped thread 8 having a free end 8*a*, from each of them.

The cutting device 15 comprises a fixed rake-shaped blade 16 having a plurality of teeth 17 corresponding to the number of loops 7 forming each of said transverse sequences. Each tooth 17 of the fixed blade 16 is disposed between two contiguous chains 5, so that it lends itself to penetrate into a respective loop 7 of each transverse sequence, as ribbon 10 moves on.

A movable blade 18 is sidable on the fixed blade 16 transversely of the extension direction of chains 5. The fixed 16 and movable 18 blades are adapted to carry out, in cooperation with each other, a single cutting-off on each loop 7 close to one of the two attachments 7*a* and 7*b* of the same loop to ribbon 10, i.e. at a position conveniently spaced apart from the angularity 12.

More specifically, the movable blade 18 has the same rake-shaped configuration as the fixed blade 16, but its pitch between two successive teeth 19 is twice the pitch between two adjacent teeth 17 of the fixed blade.

In addition, in each tooth 19 of the movable blade 18 both sides 19*a* are sharp-edged, whereas each tooth 17 of the fixed blade 16 can have a single sharp-edged side 17*a*. The latter is preferably selected in such a manner that the fixed blade 16 should comprise two successive sharp sides 17*a* alternated with two unsharp or at all events non-active sides 17*b*. Movement means 20, made in any known and/or convenient manner for a person skilled in the art, imposes a reciprocating rectilinear movement to the movable blade 18 with a stroke corresponding to the pitch between teeth 17 of the fixed blade 16.

Practically each tooth 19 slides and, at the end positions of its backwards and forwards strokes, alternately overlaps two successive teeth 17 of the fixed blade 16 having their sharp sides 17*a* turned towards each other.

Operation of a machine in accordance with the invention, described above mainly as regards structure, is as follows.

After the loops 7 have been stiffened and/or geometrically stabilized by the heat-treatment unit 14, ribbon 10 is dragged along by the collecting unit 13 until the cutting device 15. The teeth 17 of the fixed blade 16 penetrate into each loop sequence 7 and each tooth 19 of the movable blade cuts two adjacent loops in its backwards and forwards strokes, by alternately crossing its sharp side 19*a* turned in the movement direction against the sharp side 17*a* of the two teeth 17 of the fixed blade 16 between which it moves. In this way the cuts carried out by each movable tooth 19 on two transversely-adjacent loops 7 take place at the mutually-facing sharp sides 17*a* of two fixed teeth 17, i.e. astride and close to the chain 5 included between said teeth, whereas no cutting occurs at the attachments of loops 7 to chain 5 included between the non-active sides 17*b*.

Figure 5:
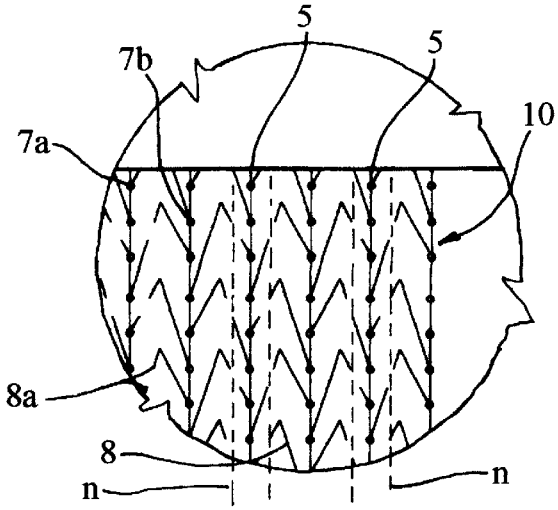
FIG. 5 is a diagrammatic front view to an enlarged scale of the ribbon after the cutting operation has been carried out on its loops so that flexible hooks are obtained from them.
Figure 6:
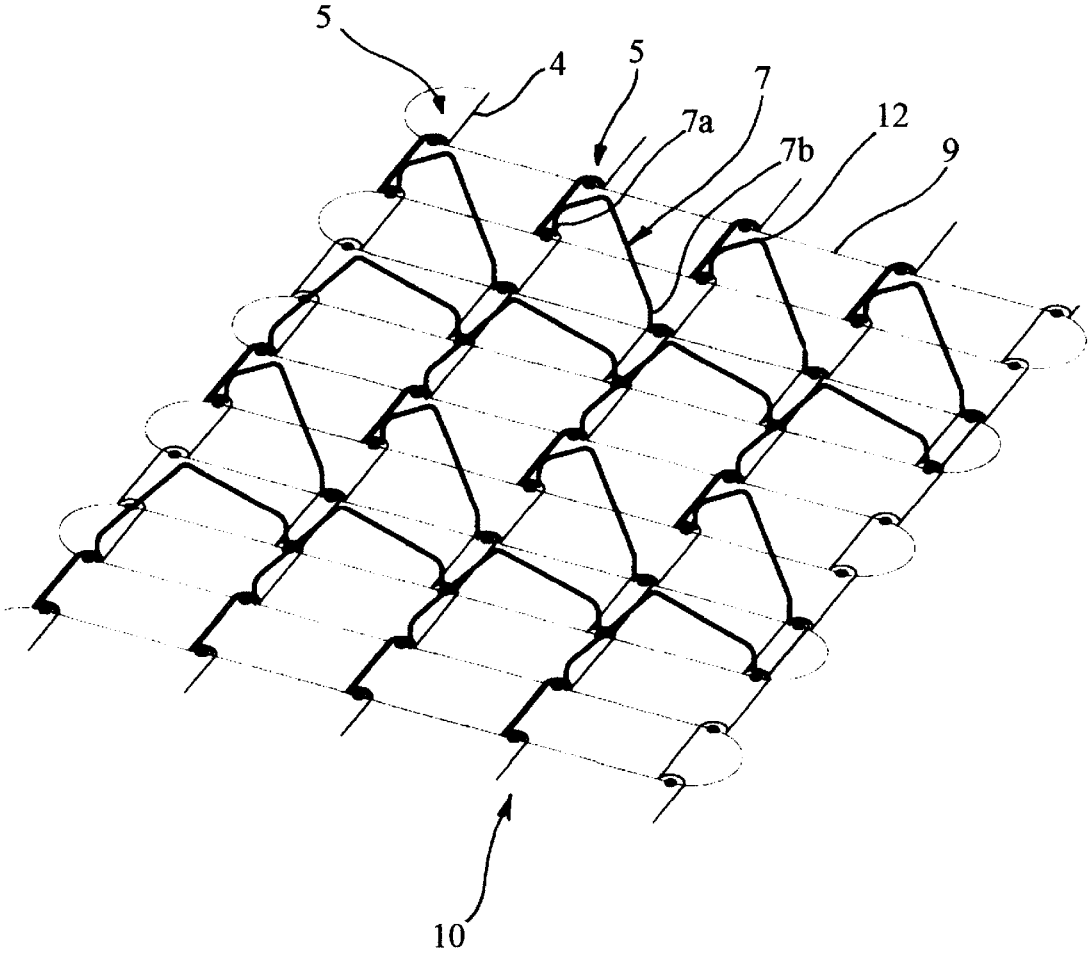
FIG. 6 is a greatly enlarged, diagrammatic perspective view of part of the ribbon before cutting of the loops.
Figure 7:
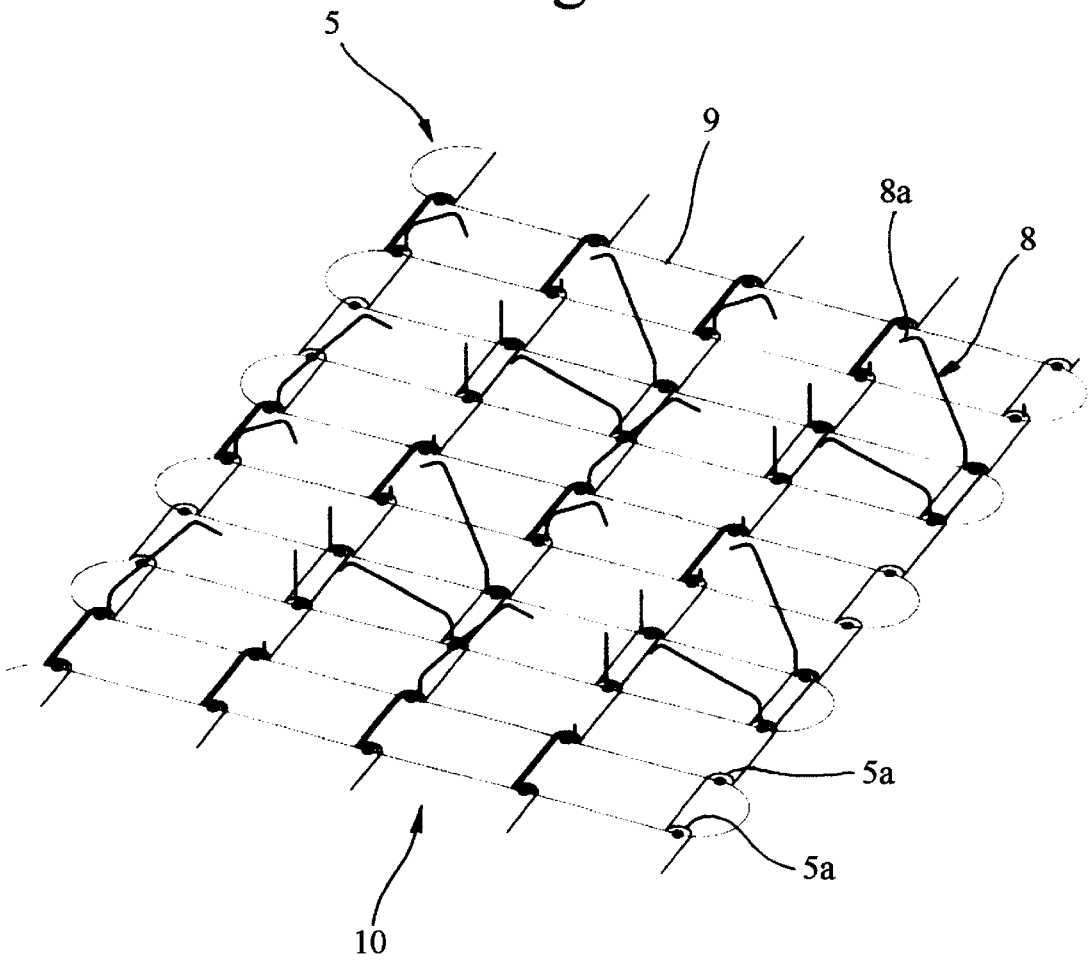
FIG. 7 is a view corresponding to FIG. 6 after cutting of the loops.

Practically, each loop 7 is cut only once, and the free ends 8*a* of hooks 8 belonging to two longitudinal rows disposed in side by side relationship, each included between two adjacent chains 5, are arranged in longitudinal lines parallel to said chains (denoted in chain line in FIG. 5) and disposed side by side. As shown in FIGS. 5 and 7, hooks 8 belonging to each pair of adjacent longitudinal rows have a respectively opposite orientation promoting an improvement in grip with the loops of the other ribbon of the tear-type closing device.

The invention puts into practice a new process which is an integral part of the present patent as well.

It consists in carrying out a previous knitting step of a ribbon 10 consisting of a plurality of parallel chains 5 interlaced with weft threads so as to form successive sequences of loops 7 therewith, which loops emerge from the ribbon 10 surface and are oriented substantially transversely of the longitudinal-extension direction of chains 5.

After appropriate shaping of loops 7, carried out as previously described, the process goes on with the step of submitting the ribbon to a heat treatment adapted to stiffen and set the geometric shape of loops 7 emerging therefrom, and ultimately carrying out a cutting operation on the stiffened loops 7 so as to obtain a length of hook-shaped thread 8 from each of them. Said cutting operation is carried out simultaneously on each successive sequence of loops 7, so that each longitudinal row of hooks 8 has its free ends 8*a* disposed substantially in a longitudinal line parallel to the extension direction of chains 5 themselves.

More specifically, the cutting operation is performed in a manner adapted to divide said longitudinal lines into pairs, for each of which the free ends of hooks 8 are disposed close to and on opposite sides of a respective chain 5, so as to form corresponding pairs of longitudinal hook rows 8 having opposite orientations with respect to each other.

The invention achieves important advantages.

In fact, the process and crochet galloon machine in accordance with the invention enable ribbons of synthetic fabric provided with hooks (that in the known art required use of needle loom machines) to be manufactured at reduced production costs as all working operations are performed on one and the same machine.

It is pointed out that the process and machine in accordance with the invention enable ribbons having hooks divided into pairs of rows with opposite orientations to be obtained, so as to promote junction with a greater number of loops of the other ribbon with which they are coupled.

What is claimed is:

1. A process for manufacturing in crochet galloon machines, ribbons of synthetic fabric provided with flexible hooks for quick-closing devices of the tear type comprising a previous step of knitting a ribbon (10) consisting of a plurality of parallel chains (5) interlaced with weft threads so as to form successive sequences of loops (7) therewith, which loops are substantially transverse to the extension direction of the chains (5) and emerge from the surface of the ribbon itself, wherein it comprises the following further steps:

submitting said ribbon (10), after formation of said loops (7), to a heat treatment adapted to substantially stiffen the loops themselves so as to set their geometric shape, carrying out a cutting operation of said stiffened loops in order to obtain a length of hook-shaped thread (8) from each of them.

2. A process as claimed in claim 1, wherein it further comprises the step of shaping each of said loops (7) so as to give it a bent extension with an angularity (12).

3. A process as claimed in claim 2, wherein each of said loops (7) is formed during the knitting step around a shaping element (11) extending parallelly of the extension direction of the chains (5), said heat-treatment step being carried out while the loops (7) are in engagement on the respective shaping elements (11).

4. A process as claimed in claim 3, wherein the loops (7) are caused to slide along the shaping element (11) during the heat-treatment step.

5. A process as claimed in claim 4, wherein the loops (7) are disengaged from the shaping elements (11) before carrying out the cutting operation.

6. A process as claimed in claim 1, wherein said cutting operation is carried out simultaneously on each successive sequence of loops (7) so that each row of hooks (8) has free ends (8*a*) disposed substantially in a longitudinal line parallel to the extension direction of the chains themselves (5).

7. A process as claimed in claim 6, wherein said cutting operation is adapted to divide said longitudinal lines into pairs for each of which the free ends (8*a*) of the hooks (8) are disposed close to and on the opposite side of a respective chain (5) so as to correspondingly form row pairs of hooks (8) having an opposite orientation with respect to each other.

8. A crochet galloon machine for manufacturing ribbons of synthetic fabric provided with flexible hooks for quick-closing devices of the tear type, comprising:

at least one needle bar (2) having needle guide grooves (2*a*) disposed in side by side relationship;

a plurality of eye-pointed needles (3) through each of which at least one respective warp thread (4) passes which is intended for forming a chain (5);

a plurality of threading tubes (6) each adapted to carry a respective weft thread;

a plurality of shaping elements (11) adapted to form successive sequences of loops (7) with the weft threads, which loops are substantially transverse to the extension direction of the chains (5) and emerge from the surface of the ribbon (10) being worked;

a ribbon collecting unit (13);

wherein it comprises:

a heat-treatment unit (14) disposed at said shaping elements (11) for substantially stiffening said loops (7) so as to set the geometric shape of same;

a cutting device (15) disposed upstream of said ribbon collecting unit (13) for cutting off said stiffened loops (7) so as to obtain a length of hook-shaped thread (8) from each of them.

9. A machine as claimed in claim 8, wherein said cutting device comprises:

a rake-shaped fixed blade (16) having a plurality of teeth (17) each located between two adjoining chains (5) for penetrating into a respective loop (7) being part of each said sequence;

a movable blade (18) sliding on said fixed blade (16) transversely of the extension direction of the chains (5), said fixed (16) and movable (18) blades cooperating with each other for carrying out a single cutting on each loop (7), close to one of the two attachments (7*a*), (7*b*) of the loop itself to the ribbon (10).

10. A machine as claimed in claim 5, wherein said movable blade (18) has a rake-shaped conformation with a pitch between two successive teeth (19) which is twice the pitch between the teeth (17) of the fixed blade (16), said movable blade (18) being provided with a reciprocating rectilinear movement the stroke of which corresponds to the pitch between the teeth (17) of the fixed blade (16), so that each tooth of the movable blade (18) cooperates with two successive teeth (17) of the fixed blade (16).

* * * * *